United States Patent [19]

Morgan et al.

[11] 4,234,338

[45] Nov. 18, 1980

[54] THERMAL SHOCK RESISTANCE CERAMIC INSULATOR

[75] Inventors: Chester S. Morgan, Oak Ridge; William R. Johnson, Maynardville, both of Tenn.

[73] Assignee: The United States of America as represented by the United States Department of Energy, Washington, D.C.

[21] Appl. No.: 973,846

[22] Filed: Dec. 28, 1978

[51] Int. Cl.[3] ..... B22F 1/04

[52] U.S. Cl. ..... 75/235; 75/232; 264/0.5; 428/539.5

[58] Field of Search ..... 75/232, 235, 237, 238; 428/539.5; 264/0.5

[56] References Cited

U.S. PATENT DOCUMENTS

| | | | |
|---|---|---|---|
| 2,952,535 | 9/1960 | Roake | 75/206 |
| 3,044,867 | 7/1962 | Edstrom | 75/235 |
| 3,069,292 | 12/1962 | Alexander et al. | 75/206 X |
| 3,143,789 | 8/1964 | Iler | 75/206 X |
| 3,150,974 | 9/1964 | Lund et al. | 75/200 X |
| 3,158,473 | 11/1964 | Gatti | 75/206 |
| 3,192,042 | 6/1965 | Spacil | 75/206 |
| 3,698,891 | 10/1972 | Patil et al. | 75/212 X |
| 3,964,878 | 6/1976 | Scheithauer, Jr. | 75/212 X |
| 4,073,647 | 2/1978 | Morgan | 75/235 |
| 4,155,758 | 5/1979 | Evans et al. | 75/232 |

*Primary Examiner*—Leland A. Sebastian

*Attorney, Agent, or Firm*—James E. Denny; Stephen D. Hamel; Allen H. Uzzell

[57] ABSTRACT

Thermal shock resistant cermet insulators containing 0.1–20 volume % metal present as a dispersed phase. The insulators are prepared by a process comprising the steps of (a) providing a first solid phase mixture of a ceramic powder and a metal precursor; (b) heating the first solid phase mixture above the minimum decomposition temperature of the metal precursor for no longer than 30 minutes and to a temperature sufficiently above the decomposition temperature to cause the selective decomposition of the metal precursor to the metal to provide a second solid phase mixture comprising particles of ceramic having discrete metal particles adhering to their surfaces, said metal particles having a mean diameter no more than ½ the mean diameter of the ceramic particles, and (c) densifying the second solid phase mixture to provide a cermet insulator having 0.1–20 volume % metal present as a dispersed phase.

11 Claims, No Drawings

THERMAL SHOCK RESISTANCE CERAMIC INSULATOR

BACKGROUND OF THE INVENTION

This invention was made in the course of, or under, a contract with the U.S. Department of Energy. It relates in general to insulation materials and more specifically to cermet insulators possessing excellent resistance to thermal shock.

Thermal shock resistant insulators are used in a variety of devices. For example, instrumentation designed for use in the study of simulated nuclear reactor loss of coolant accidents must withstand exposure to high temperature steam at about 950° C. as well as severe thermal transients, on the order of 300° C. per second. Electrical insulation for such instrumentation presents a difficult problem to the designer, since most ceramics are insufficiently ductile to withstand the severe thermal stresses. Aluminum oxide and beryllium oxide can survive exposure to hot steam but cannot withstand such severe thermal shock. Materials such as quartz, diamond and boron nitride which might survive the thermal shock are subject to leaching in hot water.

SUMMARY OF THE INVENTION

It is an object of this invention to provide a thermal shock-resistant material which is useful as a thermal or electrical insulator.

It is a further object to provide a general fabrication method to provide cermet insulators which have excellent thermal shock resistance.

These and other objects are provided according to this invention in a process for preparing cermet insulators containing 0.1–20 vol.% metal present as a dispersed phase and comprising the steps of: (a) providing a first solid phase mixture of a ceramic powder and a metal precursor; (b) heating first said solid phase mixture above the minimum decomposition temperature of said metal precursor for no longer than 30 minutes and to a temperature sufficiently above the said decomposition temperature to cause the selective decomposition of the precursor to metal, to provide a second solid phase mixture comprising particles of said ceramic powder having discrete metal particles adhering to the surface of said ceramic particles, said particles having a mean diameter no more than ½ the mean diameter of said ceramic particles; and (c) densifying the second solid phase mixture to provide a cermet article having 0.1–20 vol.% metal present as a dispersed phase.

Definitions

For purposes of this invention the following terms are defined:

(a) ceramic powder is a particulate inorganic nonmetallic crystalline material which can provide electrical or thermal insulation in a contemplated use environment;

(b) metal precursor is a metal compound which is thermally decomposable to the metal either by heating in appropriate atmosphere or vacuum or decomposable by thermal reduction by heating in a reducing atmosphere such as hydrogen;

(c) thermal decomposition is the conversion of the metal precursor to elemental metal by heating, whether purely by thermal effects or by chemical reaction of the metal precursor with a reducing atmosphere;

(d) thermal decomposition temperature is the minimum temperature (in whatever atmosphere used) in which the metal precursor will completely decompose to elemental metal within about 30 minutes.

(e) particle diameter is the equivalent sphere diameter.

(f) mean particle diameter is $(\Sigma n_i d_i)/(\Sigma n_i)$ where $n_i$ is the number of particles having diameter $d_i$.

DETAILED DESCRIPTION

It has been found according to this invention that cermets containing 0.1–20 vol.% metal as a dispersed (i.e., discontinuous) phase constitute electrical or thermal insulators which are highly resistant to thermal shock. Such insulators can be prepared by densifying metal/ceramic powder mixtures in which the metal is present as discrete particles or globules which adhere to the surface of ceramic particles and which are smaller, less than ½ the diameter of the ceramic particles. Suitable metal/ceramic powder mixtures are provided by thoroughly mixing a particulate elemental metal precursor with a ceramic powder and rapidly decomposing the metal precursor to metal in situ, i.e., within the mixture, by heating to a temperature somewhat above the minimum decomposition temperature of the precursor.

The rapid decomposition can be carried out by heating the ceramic/metal precursor mixture to a temperature about 100° C. and preferably 300° C. above the minimum decomposition temperature of the metal precursor. The decomposition of the metal precursor should be carried out at a temperature at least 100° C. below the melting or decomposition temperature of the ceramic powder, thereby selectively decomposing the precursor to its metal. When the metal precursor is rapidly decomposed in contact with the ceramic particles, the metal, having a greater chemical affinity for itself than for the oxide surface, nucleates as very small discrete particles, typically less than 3 microns in diameter, which adhere to the surface of the ceramic powder. In order to permit subsequent densification without forming a continuous metal phase, the metal particles should be smaller than the ceramic particles. The mean particle diameter of the metal should be no more than ½ the mean particle diameter of the ceramic particle. Generally, it is preferred that mean particle diameter of the metal is only 1/20 to ¼ that of the ceramic particles. In the $Pt/Al_2O_3$ system, excellent thermal resistance is obtainable in cermets containing less than 3 vol.% Pt hot pressed from $Pt/Al_2O_3$ mixtures in which approximately 90% of the metal is present as 0.1–2 micron particles and approximately 90% of the oxide is present as 0.5–8 micron particles.

After the metal precursor is decomposed, the resulting mixture can be densified by conventional means such as hot pressing to form a cermet article of up to about 100% theoretical density without causing the formation of a continuous metal phase. Consequently, the resulting article retains its usefulness as an electrical and thermal insulator. In some metal/ceramic systems, especially when less than 5 vol.% metal is desired, the thermal decomposition of the metal precursor can be performed during the hot pressing step.

It is believed that the thermal shock resistance of cermets prepared according to this invention results from the presence of a finely dispersed metal phase at particle boundaries, which roughly correspond to grain boundaries between oxide grains in the densified product. This metal phase permits a small amount of movement between the oxide grains upon exposure to thermal stresses, thereby relieving thermal stresses while the metal particles continue to bond the ceramic particles together.

It will be apparent to those skilled in the art that a wide variety of ceramic materials are suitable for use in the preparation of the cermets of this invention. The particular ceramic will ultimately depend upon the intended use environment of the article. Suitable ceramic materials include: BN, $B_4C$, $Si_3N_4$, TiC, as well as oxides such as $Al_2O_3$, $ZrO_2$, MgO, ZnO, CaO, $WO_3$, BeO, CoO, MnO, $Y_2O_3$ and the lanthanide oxides, $Cr_2O_3$, $SnO_4$, $MnO_2$, TaO, $Cu_2O$, BeO, NiO, the oxides of iron, the oxides of uranium, the oxides of thorium, the oxides of niobium, mullite and magnesia-alumina spinel. Suitable metal precursors are any metal compounds selectively reduceable to the desired metal by heating to temperatures under conditions to which the selected ceramic powder is essentially stable. Suitable metal precursors include metal compounds such as $TaH_{0.5}$, $UH_3$, $ZrH_2$, $ThH_2$, $W(CO)_6$, $Fe(NO_3)_3$, $ReCl_3$, $PtCl_4$, $PtF_3$, $CoCl_2$, $WO_3$, $MoO_3$, $CrCl_2$ and $Cr(NO_3)_3$.

It is conceivable that a ceramic powder in one system may be a suitable metal precursor in another, or vice versa. Suitable combinations of metal precursors and ceramic materials are those combinations in which the decomposition temperature of a ceramic powder in a particular atmosphere is sufficiently high relative to that of the metal precursor to permit rapid decomposition of the precursor causing the deposition of the metal as globules or the ceramic particles. To permit selective decomposition within the solid phase mixture, the ceramic powder should remain stable and unmelted at temperatures at least about 100° C. above the temperature at which the precursor is decomposed within the mixture.

Prior to selective decomposition, the metal precursor should be thoroughly mixed with the ceramic powder. This is preferably accomplished by depositing the metal precursor as a thin film onto the ceramic particles by contacting the ceramic particles with a solution or colloidal suspension of the precursor and then evaporating the solvent or suspension medium. Alternately, metal precursor particles, preferably having a mean diameter no more than ¼ that of the ceramic particles, can be thoroughly blended with ceramic particles prior to selective decomposition. When fine ceramic particles are used, a larger volume of metal can be present in the ultimate cermet without resulting in the formation of a continuous metal phase, due to the increased surface area of the ceramic particles.

When the metal precursor within the powder mixture is rapidly decomposed according to this invention, the resulting metal nucleates into discrete particles which attach themselves to the outer surface of the ceramic powder. As a general rule, the higher the temperature above the minimum decomposition temperature of the metal precursor the smaller will be the resulting metal globules, and the more uniform the dispersion of the metal phase in the densified article. Sufficiently rapid decomposition can normally be accomplished by inserting the ceramic metal precursor mixture into a furnace and heating to a temperature at least about 300° C. above the decomposition temperature of the precursor and holding for about 5–10 minutes. The decomposition steps should not involve heating the mixture above the minimum decomposition temperature for a total period longer than about 30 minutes. Longer heating times result in partial agglomeration of the discrete metal particles which tends to reduce the toughness and thermal shock resistance of the cermet.

After the decomposition step the resulting metal ceramic powder mixture is pressed into the desired shape by conventional hot-pressing techniques to achieve the desired density. Hot pressing steps should not extend beyond that time needed to achieve the desired densification, normally 50–100% theoretical density, lest metal phase migration occur resulting in the formation of agglomerates, which tend to increase the electrical and thermal conductivity of the cermet article and decrease the toughness and thermal shock resistance.

As is well known in the art of ceramic and cermet preparation, the hot pressing temperatures and pressures needed to achieve the desired densification will be dependent upon the system used. In some systems, the hot pressing atmosphere should be selected to prevent decomposition or other undesirable reactions of the cermet components.

The cermet insulators of this invention contain about 0.1–20 vol.% metal as a dispersed (discontinuous) phase. Below about 0.1 vol.% metal an increase in thermal shock resistance over the ceramic is not assured. Above 20 vol.% metal, a continuous metal phase will normally result regardless of decomposition parameters. Generally, the higher the volume of metal present in the cermet the more difficult it is to avoid the presence of a continuous metal phase. Consequently, cermet compositions for insulator applications containing only about 0.1–3.0 vol.% metal are most easily fabricable, with 0.5–2 vol.% preferred.

The conditions necessary to avoid the formation of a continuous metal phase upon densification are dependent on the compositions and the relative amounts of ceramic and metal precursor in the mixture. The larger the volume % metal to be present in the cerment, the more difficult it is to prevent the formation of a metal phase. If the metal has a high affinity for the ceramic surface, a continuous metal phase will be difficult to avoid unless very small amounts, less than 1–2 vol.%, metal are present. Such a system is Ta and $Eu_2O_3$ as described in commonly assigned U.S. Pat. No. 4,073,647, issued Feb. 14, 1978 for "Preparation of Cermets" to Chester S. Morgan, the specification of which is incorporated herein in its entirety. Generally, the smaller are the deposited metal particles relative to the ceramic particles, the easier it is to avoid continuous phase formation upon hot pressing. If microscopic examination of the metal/ceramic powder mixture after precursor decomposition reveals that the metal is coating the ceramic particles rather than being present as discrete particles, the decomposition step has been performed at an insufficient temperature. If the metal is present as particles larger than about ¼ to ½ the diameter of the ceramic powder, so that a continuous metal phase results upon densification, the thermal decomposition had been carried out for too long a time or at too high a temperature. In some systems, such as $Cr/Al_2O_3$, the preparation of cermets is complicated by chemical reactions or solid solution of metal from the ceramic, and the production of insulators will require a more accurate determination of parameters than has heretofore been done.

Based upon the teachings herein it is well within the skill of those familiar with ceramic engineering to determine the proper conditions to produce a cermet which has a dispersed metal phase from a particular ceramic. For example, if a first trial results in the formation of a continuous metal phase extending through at least a portion of the cermet, the procedure should be modified by one or more of the following:

(a) employing a smaller amount of metal precursor, (b) decomposing the metal precursor at a higher temperature and/or for a shorter time to reduce the size of metal particles present in the mixture, (c) reducing the size of the ceramic particles to increase their surface area, if the metal particles are sufficiently small, (d) reducing the size of metal precursor particles, if such particles are blended with the ceramic, or (e) employing a precursor of a metal having a lower affinity for the ceramic.

The presence of metal as a continuous phase or as a dispersed phase can be determined merely by measuring the electrical resistance across various portions of the cermet article. If the electrical resistance is low across one or more portions, i.e., less than about 1000 ohm-cm., a continuity exists in the metal phase and the cerment is unsuitable for insulation purposes. If the electrical resistance is greater than 1000 ohm-cm. across the measured portions, the metal phase is adequately dispersed and the cermet article is suitable for use as a thermal or electrical insulator. The most desirable combination of insulation and thermal shock resistant properties is obtained when the metal phase is uniformly dispersed throughout the cermet. When a metal phase of 0.1–3 vol.% is uniformly dispersed in a continuous ceramic medium, the electrical resistivity follows Maxwell's relations, i.e., the volume resistivity for the cermet decreases approximately as the volume of ceramic material decreases.

In the $Pt/Al_2O_3$ system of current interest as insulation for nuclear reactor loss of coolant test instrumentation, the cermet article of this invention contains 0.1–3 vol.% Pt as a dispersed phase. This cermet is preferably prepared by providing a first solid phase mixture of $Al_2O_3$ and $PtCl_4$ powders by evaporating a $PtCl_4$ solution in contact with $Al_2O_3$ powder. The first solid phase mixture is rapidly heated in $H_2$ at approximately 80° C./minute to at least 800° C. and held for 5–15 minutes to decompose $PtCl_4$ forming a second solid phase mixture of $Al_2O_3$ particles having smaller particles of Pt adhering to their surfaces. This second solid phase mixture is densified by hot pressing, e.g., for about 6000 psig and about 1600° C. for about one hour, or higher pressures and temperatures for shorter times.

The following examples illustrate the preparation of cermets according to this invention.

EXAMPLE I $Al_2O_3$ powder, −150 mesh US sieve size (about 100 microns) was contacted with a concentrated ethyl alcohol solution of $Fe(NO_3)_3.9H_2O$ containing sufficient iron to yield 2.9 vol.% Fe in the ultimate $Fe\text{-}Al_2O_3$ mixture. The solution was evaporated by warming the container over a hot plate while stirring. The resulting mixture of $Fe(NO_3)_3$ and $Al_2O_3$ was heated in hydrogen at atmospheric pressure at a heat-up rate of 80° C./minute to about 850° C. and held for 10 minutes. The minimum decomposition temperature is estimated to be about 550° C. The resulting mixture was examined microscopically and the $Al_2O_3$ particles found to be coated with a large number of small metal globules of diameters about 1/6 that of the $Al_2O_3$ particles. This metal-powder mixture was hot pressed at 6,000 psig and 1400° C. for 30 minutes. The cermet obtained had a density of about 82% theoretical. To test the thermal shock resistance, the cermet was quenched from 900° C. in cold water for 10 times with no cracks or other deterioration evident by 30× magnification.

EXAMPLE II $Al_2O_3$ powder (minus 150 mesh) was contacted with aqueous $PtCl_4$ solution in sufficient amount to result in about ½ vol.% Pt in the final cermet. Sufficient water is present in the solution to make a thick, uniform slurry. The solution was evaporated and the resulting $PtCl_4$-$AL_2O_3$ mixture was heated to 1000° C. in $H_2$ at a heat-up rate of 80° C./minute and held 10 minutes. The minimum decomposition temperature in $H_2$ is about 500° C. Two grams of the resulting powder was blended with 0.4 grams of a similarly treated $Al_2O_3$ powder of only 0.3 micron particle size. The blended mixture was hot pressed at 1625° C. at 6300 psig for 1.5 hours. The resulting pellet had a density of about 82.9% theoretical. The pellet was quenched from 520° C. in hot water ten times and showed no cracks or other deterioration at 30× magnification.

EXAMPLE III $Al_2O_3$ powder with particle size in the range of about ½ to 3 microns was mixed with sufficient $PtCl_4$ aqueous solution to provide 1 vol.% Pt in the ultimate cermet mixture. The mixture was evaporated with stirring and the resulting $Al_2O_3$-PtCl mixture was heated to 900° C. in $H_2$ at 80° C./minute and held for 10 minutes to decompose $PtCl_4$. The resulting mixture was blended with 15 wt.% of 0.3 micron $Al_2O_3$ powder which contained 1.5 vol.% Pt deposited in a similar manner and the blended mixture was hot pressed in a POCO graphite die at 10,600 psig for 22 minutes at 1185° to 1585° C. The small particle size $Al_2O_3$ and high pressing pressure caused the resulting sample to have a density of about 98.6 theoretical density. The sample was quenched 50 times from 520° C. to hot water and no cracks or other deterioration was detectable at 30× magnification. Helium permeability tests were run on this sample with 25 psig helium pressure on one side of the cermet and water on the other side to permit observation of bubbles. Initially, no helium permeability was found. After 50 quenches one bubble of helium formed slowly but did not come off in 7 minutes. After 5 more quenches from 820° C. to hot water, a tiny stream of helium bubbles was observed through the cermet but no cracks were visible at 30× magnification. The rate of steam leakage was then determined at 175° C. with 100 psig steam. In the first 3 hours the leak rate was 11.5 micrograms per second but this declined in a few hours to 0.80 micrograms per second.

EXAMPLE IV

Aluminum powder of about ½ to 3 micron particle size was heat treated at 1300° C. in a vacuum 3 hours to assure full conversion to alpha $Al_2O_3$ to protect against possible cracking in the high density cermet from a crystal phase transformation. Sufficient water was added to the powder to convert it to a thick paste. An aqueous solution of $PtCl_4$ containing sufficient platinum equivalent to 1 vol.% in the final cermet was added with stirring. The water was evaporated by heating the slurry with continuous stirring. After most of the water had been evaporated the powder was dried in an oven at 130° C. and then transferred to a furnace and heated for 10 minutes at 975°–1000° C. in a hydrogen atmosphere to decompose $PtCl_4$. The resulting cermet powder was then hot pressed in a POCO graphite die at 1600° C. to 1615° C. for 10 minutes at about 12,000 psig. The resulting cermet pellet had greater than 98% theoretical density. A photomicrograph exhibited a fine distribution of Pt globules within the cermet. The specimen was quenched 65 times from 520° C. to hot water. There was no evidence of cracks at 3× magnification. The helium leak test as described in Example III showed very slow bubble formation on the surface but no bubbles came off within 5 minutes.

A number of samples of alumina of various shapes and densities were tested for thermal shock resistance by quenching from 520° C. to hot water, including samples of sapphire crystals, high density alumina (99+% theoretical density) and alumina-silica (mullite). All samples tested cracked visibly at 30× magnification for 3 or fewer quenches.

EXAMPLE V $Al_2O_3$, $ZrO_2$, or MgO powder ½–5 micron average particle diameter is mixed with aqueous ethanol solution of $CoCl_2$ in sufficient amount to provide ½ to 5 vol.% Co in the densified cermet. The solvent is evaporated and the $CoCl_2$ is reduced by rapidly heating to 850° C. in $H_2$ at 1 atm. for 10 minutes. The resulting metal/ceramic powder mixture is then hot pressed at 6000 to 12000 psig and 1200° to 1700° C. for 10–30 minutes to provide a cermet of about 80–90% theoretical density.

EXAMPLE VI $ZrO_2$ or MgO powder as in Example V is contacted with aqueous $PtCl_4$ solution as in Examle II. Sufficient $PtCl_4$ solution is used to result in a vol.% Pt of 0.5 to 5% in the densified article. The solvent is evaporated and the resultant powder mixture is rapidly heated in $H_2$ at 1 atm. to 850° C. for 8 to 10 minutes. The resulting metal/ceramic powder mixture is hot-pressed at 6,000 to 12,000 psig at 1400° to 1700° C. for 10–20 minutes to provide an article of 85–98% theoretical density.

It should be understood that the examples and specific compositions disclosed herein are intended as illustrations and are not intended to limit the invention. It is contemplated that some variation can be made in the parameters described herein and still result in the preparation of a thermal shock resistant cermet insulator, and such insulators and modifications are contemplated as equivalents of those embodiments disclosed and claimed herein.

What is claimed is:

1. A process for fabricating a cermet exhibiting thermal shock resistance and electrical insulating properties and containing 0.1–20 vol.% metal present as a discontinuous phase, said process comprising the steps of:

(a) providing a first solid phase mixture of a ceramic powder and a metal precursor;

(b) heating said first solid phase mixture above the minimum decomposition temperature of said metal precursor for no longer than about 30 minutes and to a temperature sufficiently above said decomposition temperature to cause the selective decomposition of said metal precursor to said metal to provide a second solid phase mixture of particles of said ceramic powder and discrete metal particles with the latter adhering to the surfaces of said ceramic particles, said metal particles having a mean diameter no more than ½ the mean diameter of said ceramic particles, and (c) densifying said second solid phase mixture to provide a cermet having 0.1–20 vol.% metal present therein as a discontinuous phase at the boundaries of the ceramic particles.

2. The process of claim 1 wherein said ceramic powder is selected from the group of BN, $B_4C$, $Si_3N_4$, TiC, $Al_2O_3$, $ZrO_2$, MgO, ZnO, CaO, $WO_3$, BeO, CoO, $MnO_2$, $Cr_2O_3$, $Y_2O_3$, the lanthanide oxides, $SnO_4$, TaO, $Cu_2O$, BeO, NiO, the oxides of iron, the oxides of uranium, the oxides of thorium, the oxides of niobium, mullite and magnesia-alumina spinel.

3. The process of claim 1 wherein said metal precursor is selected from the group of $TaH_{0.5}$, $UH_3$, $ZrH_2$, $ThH_2$, $W(CO)_6$, $Fe(NO_3)_3$, $ReCl_3$, $PtCl_4$, $PtF_3$, $CoCl_2$, $WO_3$, $MoO_3$, $CrCl_2$, and $Cr(NO_3)_3$.

4. The process of claim 1 wherein said heating step (b) is carried out by heating said first solid phase mixture at a temperature at least 300° C. above the minimum decomposition temperature of said metal precursor.

5. The process of claim 1 wherein the ceramic is $Al_2O_3$ and the metal precursor is $PtCl_4$ and said heating step (b) is performed to at least 850° C.

6. The process of claim 5 wherein the heating step is performed in a hydrogen atmosphere.

7. The process of claim 1 in which said cermet contains 0.5–2 volume % metal.

8. The cermet prepared by the method of claims 1 or 5.

9. The cermet of claims 1 or 5 wherein said metal phase is uniformly dispersed throughout said cermet.

10. A process for preparing a cermet electrical insulator characterized by exhibiting resistance to thermal shock, comprising $Al_2O_3$ and 0.1–3 volume % Pt present as a discontinuous metal phase, said process comprising the steps of:

(a) providing a first solid phase mixture of $Al_2O_3$ and $PtCl_4$ powders, (b) heating said first solid phase mixture to at least 800° C. for about 5–15 minutes to decompose said $PtCl_4$ to Pt, forming a second solid phase mixture, and (c) densifying said second solid phase mixture to provide a cermet having Pt present therein as a discontinuous phase.

11. The process of claim 10 in which said heating step (b) is performed in atmosphere comprising $H_2$.

* * * * *